US007425027B2

(12) United States Patent
Carney

(10) Patent No.: US 7,425,027 B2
(45) **Date of Patent: *Sep. 16, 2008**

(54) MORTARBOARD

(76) Inventor: Brian P. Carney, 20676 Jutland Pl., Lakeville, MN (US) 55044

( * ) Notice: Subject to any disclaimer, the term of this patent is extended or adjusted under 35 U.S.C. 154(b) by 0 days.

This patent is subject to a terminal disclaimer.

(21) Appl. No.: 10/772,581

(22) Filed: Feb. 5, 2004

(65) Prior Publication Data

US 2004/0183319 A1 Sep. 23, 2004

Related U.S. Application Data

(60) Provisional application No. 60/445,658, filed on Feb. 7, 2003.

(51) Int. Cl.
*E04G 21/02* (2006.01)

(52) U.S. Cl. ..... 294/3.5

(58) Field of Classification Search ..... 294/3.5, 294/172, 55, 144, 7; 220/575; 206/1.7; D7/545, D7/554.3; 269/289 R, 302.1
See application file for complete search history.

(56) References Cited

U.S. PATENT DOCUMENTS

| | | | | | |
|---|---|---|---|---|---|
| 1,448,558 | A | * | 3/1923 | Maggi | 294/172 |
| 1,865,885 | A | * | 7/1932 | Byhre | 294/3.5 |
| D113,023 | S | * | 1/1939 | Tabb | D7/548 |
| 2,615,326 | A | * | 10/1952 | Matthews | 7/158 |
| 2,880,423 | A | * | 4/1959 | O'Reilly | 2/171.04 |
| 3,790,201 | A | * | 2/1974 | Morsilli | 294/3.5 |
| D259,391 | S | * | 6/1981 | Scott | D8/14 |
| 4,753,471 | A | * | 6/1988 | Gringer | 294/3.5 |
| 5,067,761 | A | * | 11/1991 | Blowers | 294/3.5 |
| 5,558,253 | A | * | 9/1996 | Malvasio | 220/575 |
| 2004/0094978 | A1 | * | 5/2004 | Netsch | 294/55 |
| 2004/0150236 | A1 | * | 8/2004 | Hobel et al. | 294/3.5 |

FOREIGN PATENT DOCUMENTS

| | | | |
|---|---|---|---|
| FR | 1494129 | * | 7/1967 |

OTHER PUBLICATIONS

Printout of webpage http://www.bontool.com/ (catalog sheets).

* cited by examiner

*Primary Examiner*—Dean J Kramer
(74) *Attorney, Agent, or Firm*—Merchant & Gould P.C.; Charles E. Golla

(57) ABSTRACT

The present invention provides an improved mortarboard configuration that is lightweight and durable. In a preferred configuration of the invention, the upper surface of the mortarboard is continuously contoured or dished to enhance retention of the material carried thereby and any water or other liquid used for retempering the material, and to provide for improved material workability. The mortarboard may have a handle to improve portability and handling.

30 Claims, 4 Drawing Sheets

FIG. 1
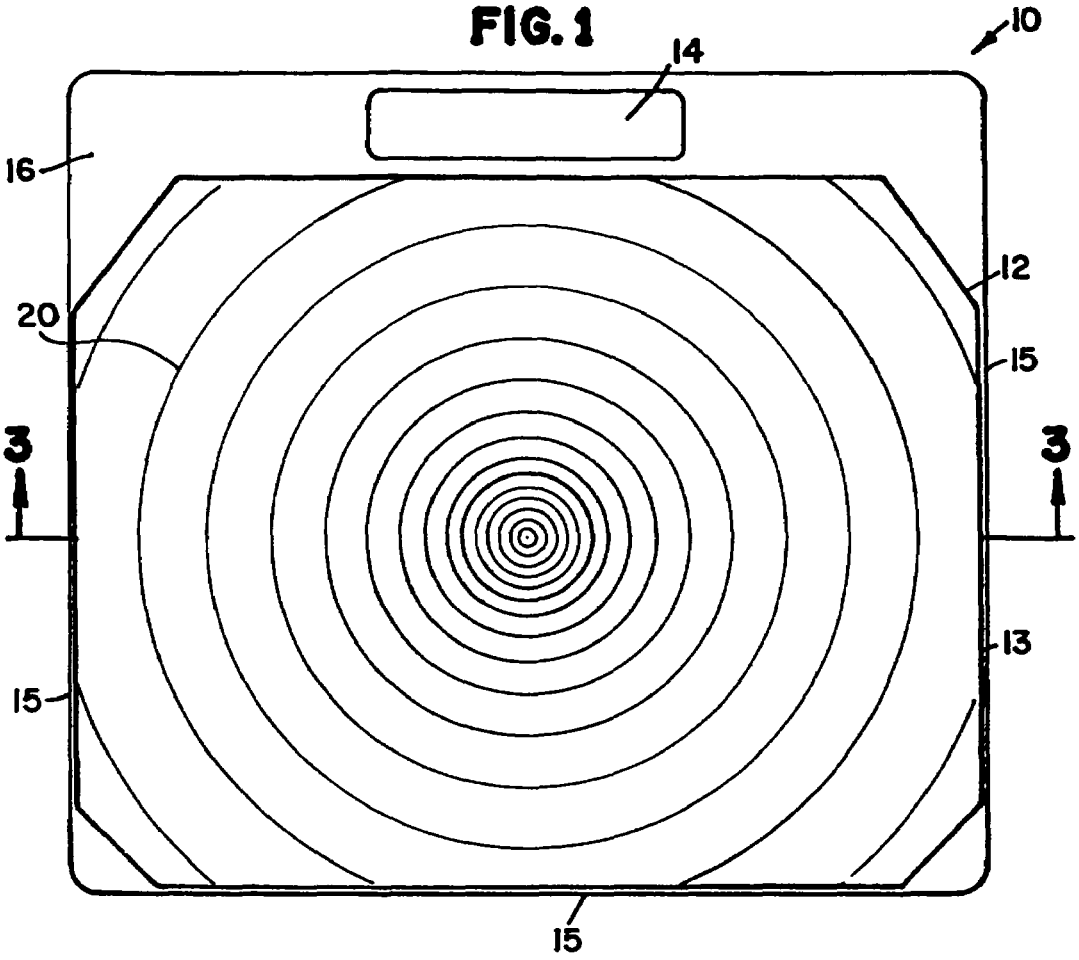
FIG. 3
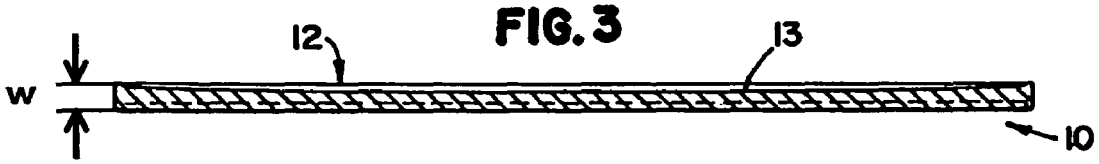
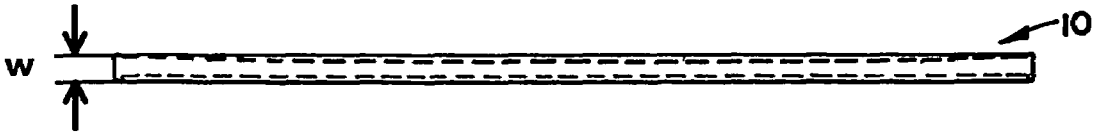
FIG. 2

FIG. 5
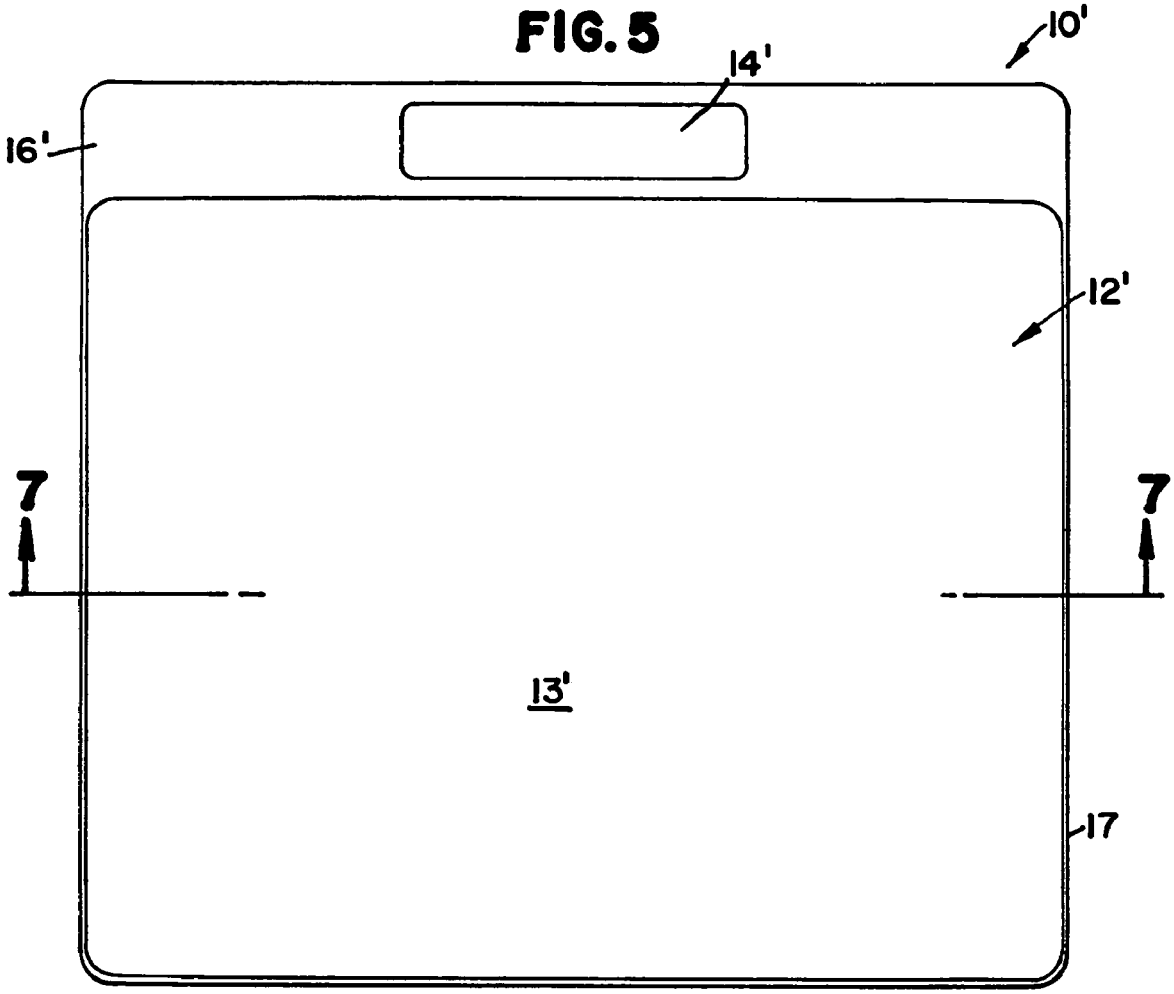
FIG. 6
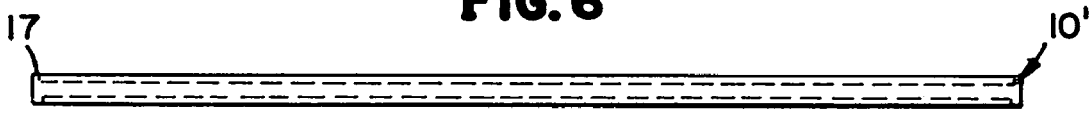
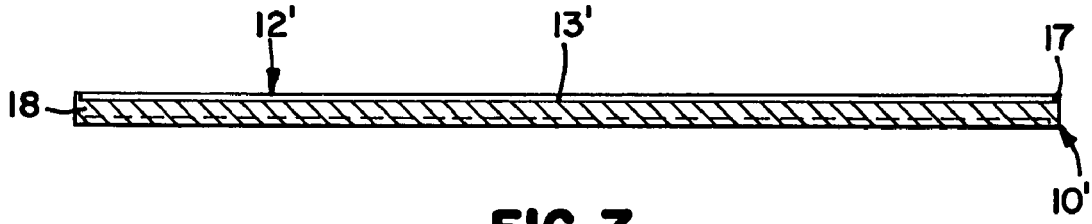
FIG. 7

MORTARBOARD

MORTARBOARD

This application claims priority under 35 U.S.C. § 119(e) to U.S. provisional application Ser. No. 60/445,658, filed Feb. 7, 2003 and entitled MORTARBOARD. The entire disclosure of 60/445,658 is incorporated herein by reference.

FIELD OF THE INVENTION

This invention relates generally to masonry products and more particularly to an improved mortarboard configuration.

BACKGROUND OF THE INVENTION

Laying and cementing brick, block and stone and the application of plaster and stucco to structural surfaces have been the hallmarks of the masonry trade for many centuries. Since the inception of the masonry trade, some type of a holding member or container has been used to hold a small quantity of mortar, cementitious material or plaster that could be used by the mason to set bricks, blocks, sintered blocks, stones and the like or for holding plaster, stucco or other such materials. It is generally preferable for such holders or containers to be relatively portable so that they can be placed immediately adjacent to the structure on which the bricks, blocks or the like are being laid or to which the plaster or stucco is being applied, so that the mason can readily and efficiently scoop by a trowel, or other applicator, a portion of mortar or other material from the holder and apply it to the structure in a single swiping motion, without undue lifting or carrying of the material between the holder and the point of its application. It will be understood, that as used herein, the term "mortar" will be used to generally refer to and include all types of cementitious materials and acrylic based products that may be applied by a mason or brick-layer or the like to a structural surface. Such products may include, but not be limited to both traditional and synthetic products such as mortar, concrete, stucco, plaster, shotcrete, tile, grout and the like. Various configurations of such holding members such as mortar boxes, bowls, pails, troughs, wheelbarrows and mortarboards have been used for such purposes.

Of such devices, the carrier typically referred to as a mortarboard has long been used in the industry, and is the mortar carrier of choice, in part due to its simplicity. In its most rudimentary form, the mortarboard is simply a flat piece of material, such as piece of plywood or the like, generally about two foot square, that can be conveniently placed along a scaffolding or other support structure on which the mason is working. Mixed mortar or other such product is typically carried by a mason attendant from a larger batch of such material, such as from a mixer, and is deposited on such mortarboards spaced along the scaffolding or support surface, such that the mason can continuously apply such material to a work structure by sequentially taking the mortar from the spaced mortarboards as he/she moves along the scaffolding or support structure.

While conceptually sound, mortarboards, and mortar boxes (i.e. those holding structures having walls providing containment depth to the structure) have suffered from a number of practical shortcomings and inefficiencies. Known mortarboards or mortar boxes generally comprise a single piece of material that does not have any carrying handle or structure that would readily enable a number of such structures to be ergonomically hand carried to or around the job site. Further, known mortar box, pail, trough and bowl structures can be difficult to use since the mason must generally dig down into the mortar or other material, to lift it out of such structures.

Known mortarboard structures have also suffered various shortcomings. Wooden mortarboards, such as those made simply by cutting a section from a piece of plywood, have a tendency to fracture and splinter, and absorb water with use, subjecting them to rot. As they absorb water, they also increase in weight and become more difficult to move. Those mortarboards made from steel have a tendency to rust and are subject to denting or deformation if struck by a hammer or the like to remove unwanted dried material that may adhere to their surfaces. Known existing mortarboards are fairly heavy, making it more difficult to move a plurality of such devices from place to place. For example, for similarly sized mortarboards, a typical plywood mortarboard can weigh approximately 10 pounds, one of 14 gauge steel is typically about 15 pounds, and one of fiberglass construction weighs approximately 7 pounds.

Those mortarboards that have flat upper surfaces have a tendency to allow moisture or water to escape from the mortar or other material being held thereby, over the edges of the board. Such escapement makes it more difficult to mix or retemper materials carried by the mortarboard. Further, the flat surface offers resistance to a straight edged applicator tool such as a trowel as the mason scrapes the applicator tool on the mortarboard surface during mixing or across the surface in the process of removing material therefrom. To address this issue, some mortarboards have been configured with a peripheral edge or lip to retain moisture and the material on the upper surface of the mortarboard. Such lip, however, can impose an obstacle to the mason's applicator tool as he sweeps or swipes the mortar or other material from the surface of the mortarboard.

The present invention addresses such prior art shortcomings of holders for mortar and other such materials, and in particular the short comings of known mortarboard configurations.

SUMMARY OF THE INVENTION

The present invention provides an improved mortarboard configuration that is lightweight and durable and which has an upper polymer surface that reduces bonding of cement, mortar and similar products (both cementitious and acrylic based) thereto, providing ready cleaning of the mortarboards without damage to the surface. In a preferred configuration of the invention, the upper surface of the mortarboard is continuously contoured or dished to enhance retention of the material carried thereby and any water or other liquid used for retempering the material, and to provide for improved material workability. The contoured surface also reduces sliding frictional contact between the mason's applicator tool such as a trowel, and the surface area, and enhances the material removal process from the mortarboard surface without excessive resistance or loss of material.

A preferred configuration of the invention includes a cutout portion which serves as a handle to permit tradesman and/or laborers to readily and efficiently carry one or a plurality of such mortarboards in a proper ergonomic manner, or to permit ready movement of a plurality of such mortarboards by a forklift or the like. The mortarboards of this invention can also be configured for nesting and ease of stacking and storage when not in use, and are preferably constructed from polymer materials which provide lightweight and structural strength and resistance to severe environmental conditions and abuse to which such mortarboards may be subjected.

According to one aspect of the invention, a mortarboard is provided for retaining and carrying mortar. The mortarboard includes a material holding surface area. The material holding surface area is continuously contoured in a dished-out manner to facilitate the retention and carrying of mortar. The mortarboard also has an outermost thickness dimension w. A central most portion of the dished-out surface is recessed less than about 3 inches from the outermost thickness dimension w.

According to another aspect of the invention, a mortarboard is provided for retaining and carrying mortar. The mortarboard includes a planar material holding surface area that is configured to retain and carry mortar. The mortarboard also includes a cut-out area portion configured to form a handle.

These and other features of the invention will become apparent upon a more detailed description of preferred embodiments of the invention as described below.

BRIEF DESCRIPTION OF THE DRAWINGS

Referring to the Drawing, where like numerals represent like parts throughout the several views:

FIG. 1 is a front elevational view of a mortarboard configured according to the principles of this invention;

FIG. 2 is a side elevational view of the mortarboard of FIG. 1;

FIG. 3 is a cross-sectional view taken generally along the Line 3-3 of FIG. 2;

FIG. 5 is a front elevational view of a second embodiment of a mortarboard configured according to the principles of this invention;

FIG. 6 is a side elevational view of the mortarboard of FIG. 5;

FIG. 7 is a cross-sectional view taken generally along the Line 7-7 of FIG. 6;

DETAILED DESCRIPTION OF THE PREFERRED EMBODIMENTS

Figure 4:
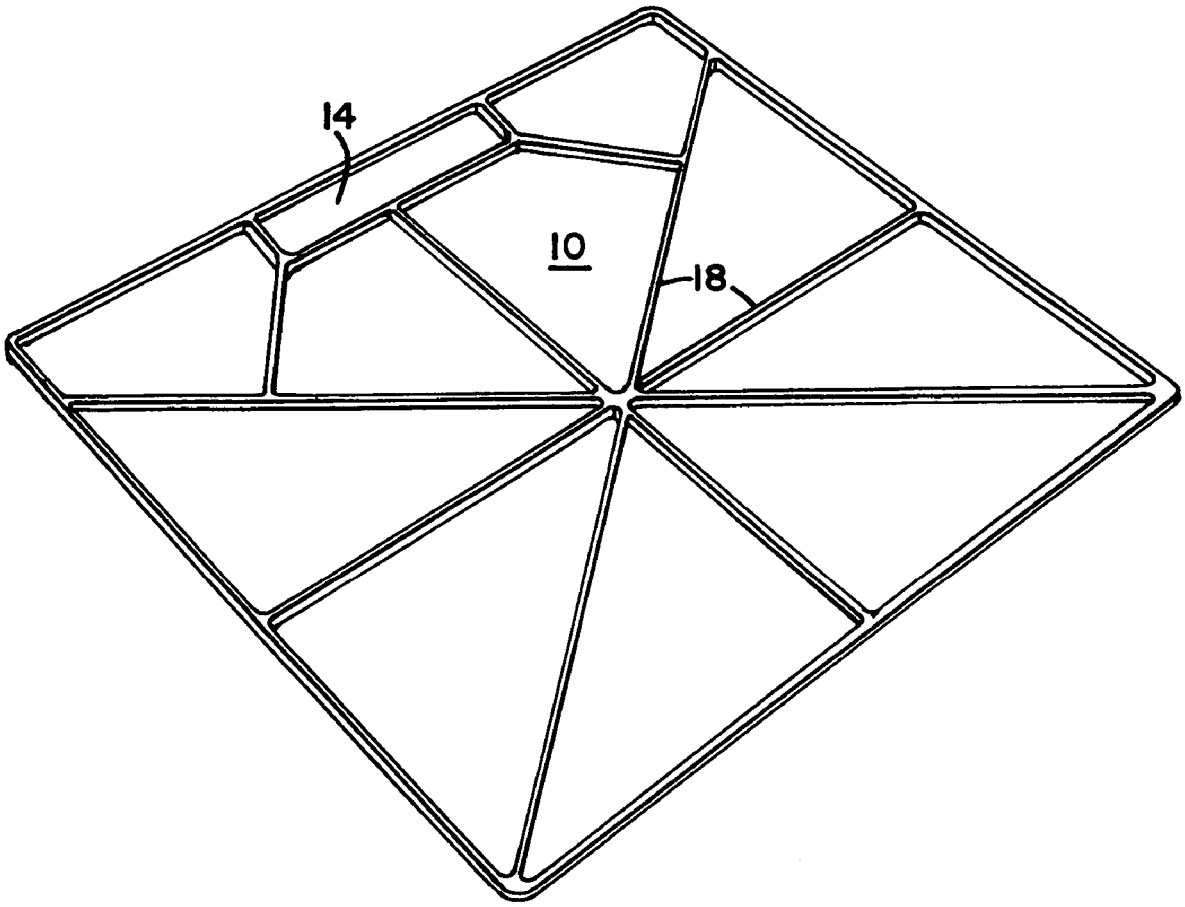
FIG. 4 is a perspective bottom view of the mortarboard configurations of FIGS. 1 and 5.

A first preferred embodiment of the mortarboard apparatus incorporating the principles of this invention is illustrated at 10 in FIGS. 1-4 and FIG. 8. The mortarboard is preferably made from a polymer material such as polyethylene, polypropylene, urethane, nylon, polycarbonate, ABS, PVC, or the like. Such polymers may be lightweighted with a blowing agent such as with nitrogen pellets, to create a structural foam structure, as is well-known in the art. The mortarboard 10 may be formed by known methods of constructing polymer material such as by injection molding, compression molding, roto molding, or other known methods. Such polymer materials provide significant strength, yet are relatively lighter in weight than previously used mortarboard material such as wood, steel or fiberglass. For example, a mortarboard configured as illustrated in the Figures might weigh as little as 5 pounds. Further, as constructed from polymer material, the mortarboard will not absorb water or moisture, or splinter, flake, rust, rot or leak. In particular, the polymer resins used in the mortarboard will not fracture or splinter like wooden mortarboards in freezing temperatures, nor warp or become disfigured in hot, blistering conditions. Further, as a result of the mortarboard's polymer surfaces, cementitious products and most acrylic based products such as mortars, concrete, stucco, plaster, shotcrete, tile grount and the like with which the mortarboard would typically be used, are prevented form forming a long-term bond to the mortarboard's surfaces. Unlike wood or steel mortarboards, or mortar boxes or pans, cementitious materials and other products with which the mortarboard is used easily wash off with plain water or water treated with cleaners or acids, without damaging the polymer surfaces. Further, if some of such materials with which the mortarboard is used were to adhere to the mortarboard surfaces, the polymer material is strong enough to resist impacts from tools such as a hammer or the like which could be used to strike the board so as to flake off any such unwanted residue materials, without imparting damage or deformation to the mortarboard.

The mortarboard 10 of the preferred embodiment comprises a generally rectangular structure having a substantially flat material area. A broad material holding surface area 12 is included in the mortarboard. It will be understood that the principles of this invention would apply to other, non-rectangular shapes as well. The holding area 12 forms a working surface upon which the cementitious mortar or other material (not illustrated) is placed. One end of the mortarboard, contiguous with the holding area 12, has a cut-out portion 14 that forms a carrying handle for the mortarboard. The cut-out portion 14 is defined by the substantially flat material area. The handle opening is sized for ease of hand carrying or loading onto the forks of a forklift truck at a job site, such that a plurality of such mortarboards can be loaded and raised to elevated scaffolds many floors above ground level.

Alternatively, the handle may be formed in other configurations. For example, the handle can be separately attached to the mortarboard by any number of ways. The handle can be of the same material as the mortarboard, or it may be made of a different material, such as rope, cloth, metal, etc.

In the preferred embodiment, there is an area generally illustrated at 16, adjacent the cut-out handle portion which can be used for printed indicia, engraved logos, promotional materials or the like and for the printing of safety, use or other printed information.

In the preferred embodiment, the mortarboard 10 preferably has a width of approximately 24 inches and a height of approximately 24-30 inches with the upper area 16 adjacent the handle being approximately 4 to 6 inches. The surface holding area 12 is preferably 24 inches wide and from 20-26 inches in height (as illustrated in FIG. 1) to provide a suitable material holding and working surface. The mortarboard is preferably less than 1 inch, and more preferably less than about 0.75 inches in thickness. In a preferred embodiment, the thickness is between 0.5 inches and 0.75 inches.

The mortarboard preferably has a bottom surface formed by supporting ribs 18 which provide structural strength to the mortarboard, while eliminating unnecessary weight therefrom. Such ribbed structure can assume any desired configuration which will provide the desired structural strength and integrity to the mortarboard. Further, the lower support structure of the mortarboard can be configured in a manner so as to cooperatively mate and nest with the upper surface of another mortarboard for enhanced stacking of a plurality of such mortarboards.

In the preferred embodiment of the invention illustrated in FIGS. 1-4, the upper surface 13 of the broad material surface holding area 12 is continuously contoured or dished as illustrated in FIGS. 1 and 3, with the lower most portion of the dished-out surface being located centrally of the broad material surface holding area 12. Contour lines 20 in FIG. 1 illustrate different heights of the surface holding area 12.

Although the contour lines 20 are shown in discrete increments, it is to be understood that the surface holding area 12 is dished-out in a continuous manner between the contour lines 20. The degree or depth of the dished-out recess can vary, as can the thickness dimensions of the mortarboard.

The central most portion of the dished-out upper surface 13 is recessed less than about 3 inches from the outermost thickness dimensions of the mortarboard, more preferably less than about 1 inch, and even more preferably less than about 0.5 inches. In the preferred embodiment, the central most portion of the dished-out upper surface 13 is recessed from about 0.25 inches to about 0.375 inches from the outermost thickness dimensions w of the mortarboard. Preferably, the radius of curvature or radii of curvature of the dished-out portions is/are significantly larger than the thickness dimensions and may be as large or greater than the width or height dimensions of the mortarboard. In the preferred embodiment, the dished-out area of the upper surface extends completely to one or more edges of the mortarboard, without any peripheral lip or raised edge portion projecting from the upper surface 13, so that a mason's tool can slide from the central portion of the upper surface 13 and over the edge of the mortarboard, without engaging any lip or encumbrance that would prevent free sliding motion of the user's tool such as a trowel or the like. Alternatively, there can be a slight peripheral lip or raised edge portion 15 can be included on the bottom and side surfaces of the surface holding area 12, as shown in FIG. 1. The peripheral lip is preferably configured so that the adjacent recessed portion of the upper surface is less than about 0.5 inches, more preferably less than about 0.375 inches, and even more preferably less than about 0.25 inches.

The smoothed dish contoured area of the mortarboard upper surface 13 also reduces sliding frictional contact between the user's tool and the upper surface area 13, as compared to a mortarboard surface that would be flat or planar. The contour of the dished upper surface 13 also enhances the "scooping" of material such as mortar or plaster from the upper surface 13 without resistance or loss of material, and acts to retain the material and any water or liquid mixing agents that might be used for retempering the held material, thus improving the ability to "work" the material on the upper surface. The dished-out upper surface 13 also enhances the ability to mix the material held on that surface. The dished-out upper surface 13 acts like a shallow mixing bowl and easily permits a user to mix the material and any water or liquid mixing agents together on that surface.

The overall size of the board and the cut-out handle portion enables a user to easily carry the mortarboard in ergonomically correct methods alongside the carrier's body, without requiring the carrier to use two hands to carry or support the mortarboard during transport. The board's reduced weight, cut-out handle and minimum thickness allows the laborer or mason to easily carry or transport 3 to 5 mortarboards in each hand, a task which would be very difficult or unfeasible with prior art mortarboards. In the preferred embodiment, the cut-out handle portion 14 is approximately 2 inches by 6-9 inches; however, it will be understood that other appropriate sized handle configurations would apply to this invention.

A second embodiment of the invention is illustrated in FIGS. 4-7. It will be appreciated from this description that the bottom configurations for the first and second mortarboard embodiments illustrated in FIG. 4 could apply to all illustrated embodiments of the invention. The differences therebetween lie in the configuration of the upper surfaces of the material surface holding area. For ease of description, common portions or elements of the first and second embodiments of the mortarboard are designated by the same numerical designations, with the numerical designations used for the second embodiment including an additional prime (') symbol. In the second embodiment mortarboard 10', the upper surface 13' of the broad material surface holding area 12' is generally planar, and recessed below that surface area defined by the upper handle portion 16' and a peripheral raised lip portion 17. The raised lip 17 provides a retaining border for the upper surface 13' for retaining materials and liquid products held or carried by the upper surface 13' of the mortarboard 10'. As with the first embodiment mortarboard 10, the second mortarboard embodiment 10' includes an integrally formed cut-out handle 14' for facilitating movement and carrying of the mortarboard 10'. According to a preferred construction of the second embodiment mortarboard, the upper surface 13' thereof is recessed by approximately ⅛ of an inch from the upper surface of the raised peripheral lip 17. It will be understood, however, that the amount of recess could be varied by those skilled in the art. As with the first mortarboard embodiment, the thickness of the second mortarboard embodiment 10' can vary to meet the desired structural needs thereof, and would most preferably range from between about 0.5 inches to 0.75 inches.

Figure 8:
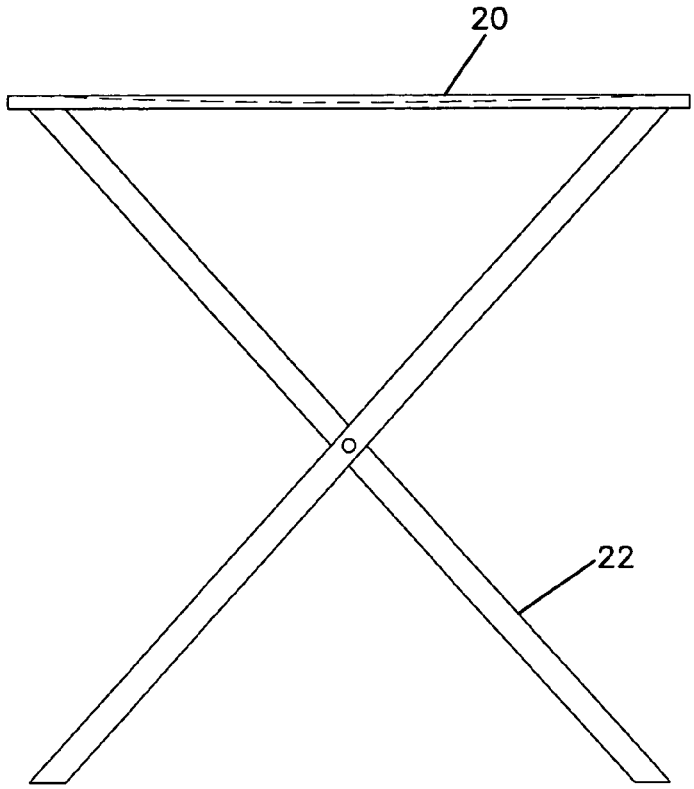
FIG. 8 is a side view of a mortarboard configured to be placed on a support stand.

It will be appreciated that the intended use for the mortarboard configurations of this invention is for such mortarboards to be placed upon a support surface such that the bottom of the mortarboard engages the support surface, and the upper surfaces 13 and 13' face upwardly so as to accommodate the acceptance of a charge of mortar, cementitious or other such product thereon. The invention further contemplates the use of a support stand configured to retainably hold and elevate the mortarboard in elevated position relative to a lower support surface. In such case, the bottom portion of the mortarboard may be configured to include reinforced areas for retainably accepting and matably engaging with such a support stand. Such support stands may be of varied configurations, such as three or four-legged structures and could be collapsible in nature. FIG. 8 illustrates such a support stand. The support stand 22 shown in FIG. 8 includes two pairs of cross-pivoted legs connected together through the pivot point. The top of each leg fits into an opening or recess in a bottom surface of the mortarboard 20. For example, the ribs shown in the previous embodiment could be configured to accept the top of the legs into the corners of the bottom of the mortarboard.

Figure 9:
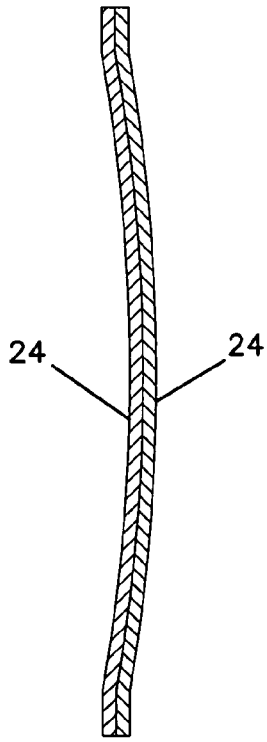
FIG. 9 is a cross-sectional view illustrating mortarboards that are configured to be nested with each other.

As noted above, a mortarboard of the present invention can be configured to nest with another mortarboard. For example, a lower support structure of the mortarboard can be configured in a manner so as to cooperatively mate and nest with the upper surface of another mortarboard for enhanced stacking of a plurality of such mortarboards. FIG. 9 illustrates such a nesting arrangement of mortarboards 24.

The invention also contemplates the use of retaining guide structures which may be used to retainably hold a plurality of such mortarboards in stacked manner for facilitated transport or storage of a large number of such mortarboards.

Further, while a single polymer material has been described for configuring the preferred mortarboards of this invention, those skilled in the art will recognize that mortarboard structures of composite materials or multiple materials could also be employed which practice the principles of this invention. However, in such structures, it is preferably that the portion of the mortarboard forming the broad material surface holding area 12 and the upper surface 13 thereof be constructed of a polymer material that possesses the non-stick and other hereinbefore described advantages.

The above specification and described embodiments provide specific descriptions of structures which possess the inventive features of this invention. Other embodiments of the invention can be made without departing from the spirit and scope of the invention which will reside in the claims hereinafter appended.

What is claimed is:

1. A mortarboard configured for operative use by masons and brick layers at a construction site, comprising;

a. a generally rectangular sheet material having an outermost thickness of at least about 0.5 inches and defining a broad continuous upper working surface, wherein said upper working surface is slightly contoured in continuous dished-out manner from each of the sides of said upper working surface across substantially the extent of said upper working surface, the radius of said contour being equal in all directions from a central position on the working surface and toward each of said sides;

b. said upper working surface being sized and configured to retainably hold an operative quantity of cementitious mortar to be worked by an operator, and being impervious to retain moisture in the mortar;

c. said sheet of material defining a cut-out handle portion formed entirely through said sheet material adjacent one edge of said material and sized to accept an adult person's hand or fork-lift tine to facilitate carrying of said mortarboard in a generally vertical manner when not in operative use; and d. wherein mixing of mortar on said working surface by scraping a trowel over said contoured surface is facilitated.

2. The mortarboard of claim 1, wherein said impervious upper working surface comprises polymer material.

3. The mortarboard of claim 1, wherein said sheet material comprises polymer material.

4. The mortarboard of claim 1, wherein said outermost thickness of said sheet material is between about 0.5 to 1 inch.

5. The mortarboard of claim 1, wherein the sheet material has a width dimension measured between first and second opposed edges and a height dimension measured between third and fourth opposed edges, wherein said width and height dimensions are greater or equal to about 24 inches.

6. The mortarboard of claim 1, wherein said cut-out handle portion has a width of greater or equal to about 6 inches.

7. The mortarboard of claim 1, wherein the weight of the mortarboard is about 5 pounds.

8. The mortarboard of claim 1, further including a plurality of support ribs integrally formed with said sheet material, configured and arranged to provide structural support for said upper working surface.

9. The mortarboard of claim 1, further including raised peripheral lip portions along at least three sides of said upper working surface.

10. The mortarboard of claim 9, wherein said raised peripheral lip portions extend less than about 0.375 inches above the upper working surface.

11. The mortarboard of claim 1, wherein the radius of curvature of the dished-out contour of said working surface is larger than the largest width or height dimension of said working surface.

12. The mortarboard of claim 1, wherein a lowermost portion of the dished-out upper working surface is recessed less than about 0.5 inches from an uppermost portion of the upper working surface.

13. The mortarboard of claim 1, wherein the material is configured so that a front and rear surface of the material will nest together with other mortarboards of like construction, when more than one mortarboards are stacked together.

14. The mortarboard of claim 1, wherein said sheet material is of a strength to resist breaking or damage to said working surface when struck by construction tools.

15. A strong, lightweight mortarboard configured for operable use by masons and brick layers at a construction site, comprising:

a. a board-like sheet material having an outermost thickness of at least about 0.5 inches and defining a continuous smooth solid broad upper working surface extending generally across the entire width of said sheet material between opposed side edges thereof; said sheet material being configured so that a front and a rear surface of the material will nest together with other mortarboards of like construction when more than one mortarboards are stacked together;

b. said upper working surface being sized and configured to retainably hold an operative quantity of cementitious mortar to be worked by an operator, and being impervious to retain moisture in the mortar;

c. said sheet material being slightly contoured across said upper working surface in dished-out manner in a single continuous arc extending from each of the sides of said upper working surface to form a single continuous arcuate contour across the working surface; and d. whereby an operator can work mortar on said mortarboard by moving a trowel or shovel in a sweeping motion without engaging any irregularities across the mortarboard that would interfere with continuous movement of the shovel or trowel during the mortar working operation, and wherein mixing of mortar on said surface by scraping a trowel over said contained surface is facilitated.

16. The mortarboard of claim 15, wherein said upper working surface comprising polymer material.

17. The mortarboard of claim 15, wherein said sheet material comprises polymer material.

18. The mortarboard of claim 15, wherein said outermost thickness of said sheet material is between about 0.5 to 1 inch.

19. The mortarboard of claim 15, further including a carrying handle for carrying the mortarboard in generally vertical manner when not in operative use.

20. The mortarboard of claim 15, further including a plurality of support ribs integrally formed with said sheet material, configured and arranged to provide support for said upper working surface in a manner so as to not interfere with the smooth continuous nature of said working surface.

21. The mortarboard of claim 15, wherein a lowermost portion of said dished-out working surface is recessed less than about 0.5 inches from an uppermost portion of the working surface.

22. The mortarboard of claim 21, wherein a lowermost portion of said dished-out working surface is recessed less than about 0.375 inches from an uppermost portion of the working surface.

23. The mortarboard of claim 22, wherein a lowermost portion of said dished-out working surface is recessed less than about 0.25 inches from an uppermost portion of the working surface.

24. The mortarboard of claim 15, wherein the contour of said upper working surface has a single radius of curvature about a point located generally above a central portion of the working surface.

25. The mortarboard of claim 24, wherein the radius of curvature is larger than the largest width or diameter dimension of said working surface.

26. The mortarboard of claim 15, wherein the upper working surface has a width dimension greater or equal to about 24 inches.

27. The mortarboard of claim 15, wherein the mortarboard further defines a bottom surface opposite of said working surface, arranged and configured to operatively accommodate a support stand for the mortarboard.

28. The mortarboard of claim 15, wherein said sheet material is of a strength to resist breaking or damage to said working surface when struck by construction tools.

29. A strong, lightweight mortarboard configured for operable use by masons and brick layers at a construction site, comprising:

a. a board-like sheet material having an outermost thickness of at least about 0.5 inches and defining a continuous smooth solid broad upper working surface extending generally across the entire width of said sheet material between opposed side edges thereof;

b. said upper working surface being sized and configured to retainably hold an operative quantity of cementitious mortar to be worked by an operator, and being impervious to retain moisture in the mortar;

c. said sheet material being slightly contoured across said upper working surface in dished-out manner in a single continuous arc extending from each of the sides of said upper working surface to form a single continuous arcuate contour across the working surface;

d. said sheet material including carrying handle for carrying the mortarboard in generally vertical manner when not in operative use, comprising a cut-out portion defined by said sheet material extending entirely through said sheet material; and e. whereby an operator can work mortar on said mortarboard by moving a trowel or shovel in a sweeping motion without engaging any irregularities across the mortarboard that would interfere with continuous movement of the shovel or trowel during the mortar working operation, and wherein mixing of mortar on said surface by scraping a trowel over said contoured surface is facilitated.

30. A strong, lightweight mortarboard configured for operable use by masons and brick layers at a construction site, comprising:

a. a board-like sheet material having an outermost thickness of at least about 0.5 inches and defining a continuous smooth solid broad upper working surface extending generally across the entire width of said sheet material between opposed side edges thereof;

b. said upper working surface being sized and configured to retainably hold an operative quantity of cementitious mortar to be worked by an operator, and being impervious to retain moisture in the mortar;

c. said sheet material being slightly contoured across said upper working surface in dished-out manner in a single continuous arc extending from each of the sides of said upper working surface to form a single continuous arcuate contour across the working surface;

d. a carrying handle configured to carry the mortarboard in generally vertical manner when not in operative use, wherein said carrying handle defines an aperture sized and configured to operatively accept a person's hand or a tine of a fork-lift therethrough; and e. whereby an operator can work mortar on said mortarboard by moving a trowel or shovel in a sweeping motion without engaging any irregularities across the mortarboard that would interfere with continuous movement of the shovel or trowel during the mortar working operation, and wherein mixing of mortar on said surface by scraping a trowel over said contoured surface is facilitated.

* * * * *

UNITED STATES PATENT AND TRADEMARK OFFICE

CERTIFICATE OF CORRECTION

PATENT NO. : 7,425,027 B2
APPLICATION NO. : 10/772581
DATED : September 16, 2008
INVENTOR(S) : Brian P. Carney It is certified that error appears in the above-identified patent and that said Letters Patent is hereby corrected as shown below:

On the title page, under "Notice", in column 1, line 6, delete the phrase "This patent is subject to a terminal disclaimer."

Signed and Sealed this

Twenty-eighth Day of July, 2009

John Doll

JOHN DOLL
*Acting Director of the United States Patent and Trademark Office*